US005120075A

United States Patent [19]

Duggan

[11] Patent Number: 5,120,075

[45] Date of Patent: Jun. 9, 1992

[54] BINDER SPINE ASSEMBLY

[75] Inventor: Ray Duggan, Hove, England

[73] Assignee: Marshall Cavendish Services Ltd., Great Britain

[21] Appl. No.: 460,893

[22] PCT Filed: Jun. 9, 1989

[86] PCT No.: PCT/GB89/00645

§ 371 Date: Feb. 12, 1990

§ 102(e) Date: Feb. 12, 1990

[87] PCT Pub. No.: WO89/12555

PCT Pub. Date: Dec. 28, 1989

[30] Foreign Application Priority Data

Jun. 14, 1988 [GB] United Kingdom ..... 8814085

[51] Int. Cl.[5] ..... B42D 3/18

[52] U.S. Cl. ..... 281/47; 281/48; 281/49

[58] Field of Search ..... 281/45, 46, 47, 48, 281/49

[56] References Cited

U.S. PATENT DOCUMENTS 2,960,090 11/1960 Shugart ..... 281/47

4,243,459 1/1981 Lawes ..... 281/47 X

FOREIGN PATENT DOCUMENTS 2284469 4/1976 France ..... 281/47

518849 3/1940 United Kingdom ..... 281/48

557596 11/1943 United Kingdom ..... 281/47

1326081 8/1973 United Kingdom ..... 281/47

*Primary Examiner*—Paul A. Bell

*Attorney, Agent, or Firm*—Lucas & Just

[57] ABSTRACT

A spine assembly (1) for a binder (20, 21, 22) comprises a base portion (2) and a lid portion (6) releasably fixable to the base portion (2), the lid (6) and base (2) portions forming a tubular spine structure when fixed together, and a plurality of elongate loops (13), each loop having two substantially parallel longer sides and two shorter ends (**12, 12*a*), the loops (13) being positionable about the lid portion (6) of the spine so that one of the longer sides extends longitudinally within the tubular spine structure when the lid (6) is fixed to the base and the other longer side extends longitudinally of the spine and adjacent the outer surface of the lid portion (6). A slot (16) may be provided in the lid (6) to allow loops (13, 5) of different sizes (M1, M2, M3**) to be simultaneously accommodated in the spine.

18 Claims, 6 Drawing Sheets

BINDER SPINE ASSEMBLY

The present invention relates to binders, and is particularly concerned with binders intended to contain a plurality of magazines or the like in book form.

Hitherto, binders have been known which comprise two cover boards, a curved spine, and a flat retaining board extending between the cover boards adjacent the spine to form a tunnel therewith. Magazines are held in the binder by being passed under the exposed parts of loops positioned round the retaining board, the loops having a concealed part extending through the tunnel and an exposed part extending back along the length of the retaining board. The loops are of course placed round the retaining board prior to its fixing to the remainder of the binder, and cannot subsequently be removed except by cutting. More importantly, however, additional loops cannot be added to a finished binder, and thus any deficiency in the number of loops makes the entire binder unsaleable.

The object of the present invention is to provide a spine arrangement for a binder of the type described above which can accept additional loops and permit the selective removal and replacement of loops and/or their contents without damage.

According to the present invention, a binder spine comprises a base portion and a lid portion which when closed together form an elongate tubular structure, a plurality of loops being positionable round the lid portion prior to closure of the spine so as to extend longitudinally through the spine and return along the outside of the spine lid portion, the spine base portion being adapted for fixing into a spine region of a binder. The tubular structure may be of rectangular section, or may have one or more curved sides to give, for example, a "D" shape section.

The lid and base portions may be separate components, adapted to be fixed together by, for example, snap-engagement. The lid and base may be formed of identical sections of extruded or moulded plastics material.

Preferably, however, the lid and base portions of the spine are hingedly attached along adjacent longitudinal edges. Most preferably, the hinged lid and base portions are held in their closed position by a resilient engagement between a longitudinal edge of the lid and a longitudinal edge of the base. In a modification of this preferred embodiment, a slot may be formed in the lid so as to extend transversely across the lid from its longitudinal edge opposite the hinge, this slot allowing loops of a second, smaller, size to be held by the spine, these smaller loops extending through the tubular spine from one end, passing out through the slot, and returning along the outside of the spine lid. The spine lid and base are preferably extruded from plastics material, most preferably as an integral extrusion by joining them at a longitudinal hinge line.

The lid and base may be of different plastics materials, integrally co-extruded, to permit the mechanical properties of the lid and base to differ. Most preferably the lid and base are of polyvinyl chloride, and are joined together by a hinge of a different material, the lid base and hinge being simultaneously co-extruded.

As an alternative, the lid or base may be formed from metal strip, or the entire spine may be bent from resilient metal strip.

An embodiment of the invention will now be described in detail, with reference to the accompanying drawings, in which.

Figure 1:
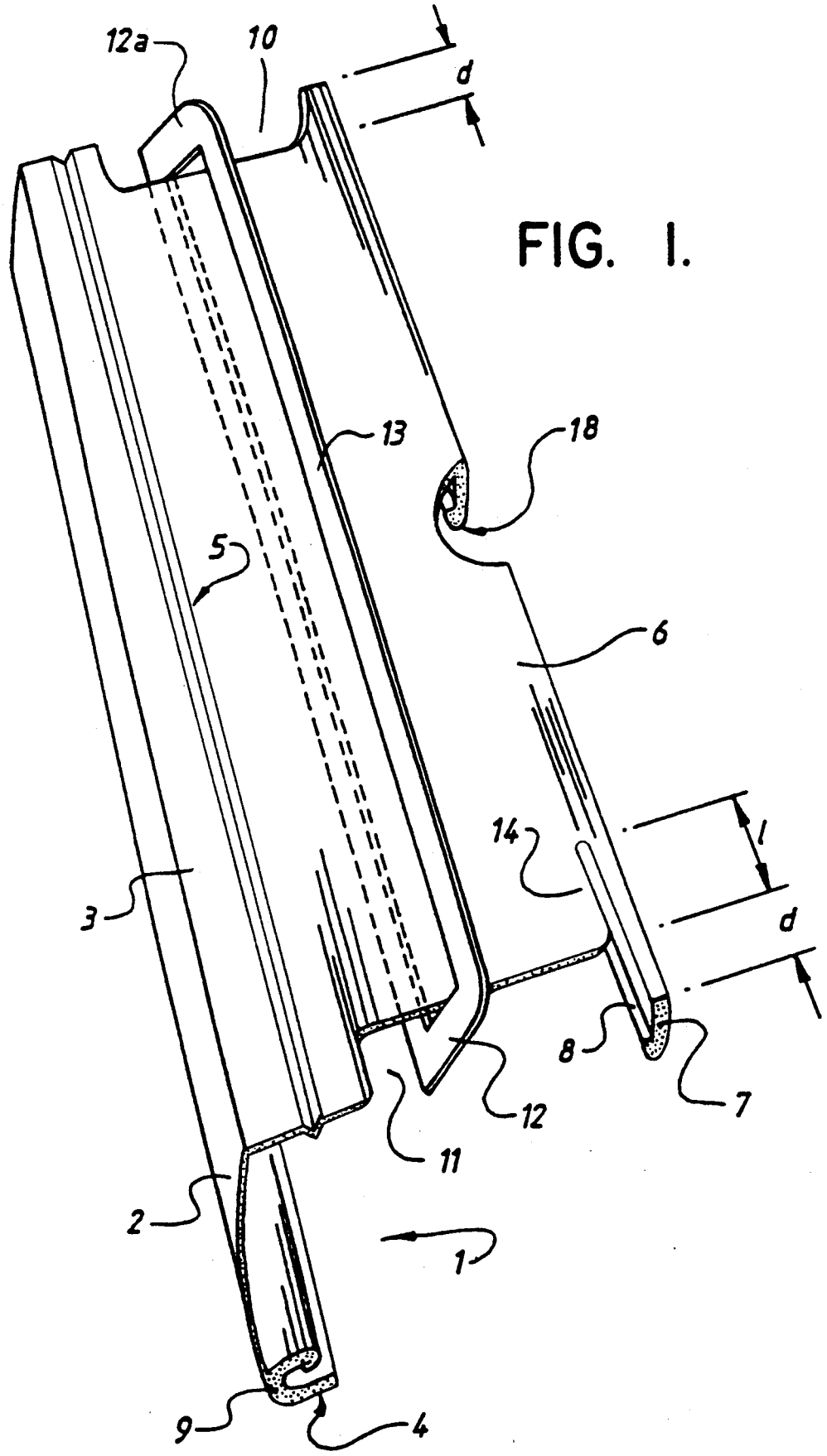
FIG. 1 is a perspective view of an integrally extruded spine in the open position with one loop fitted.
Figure 2:
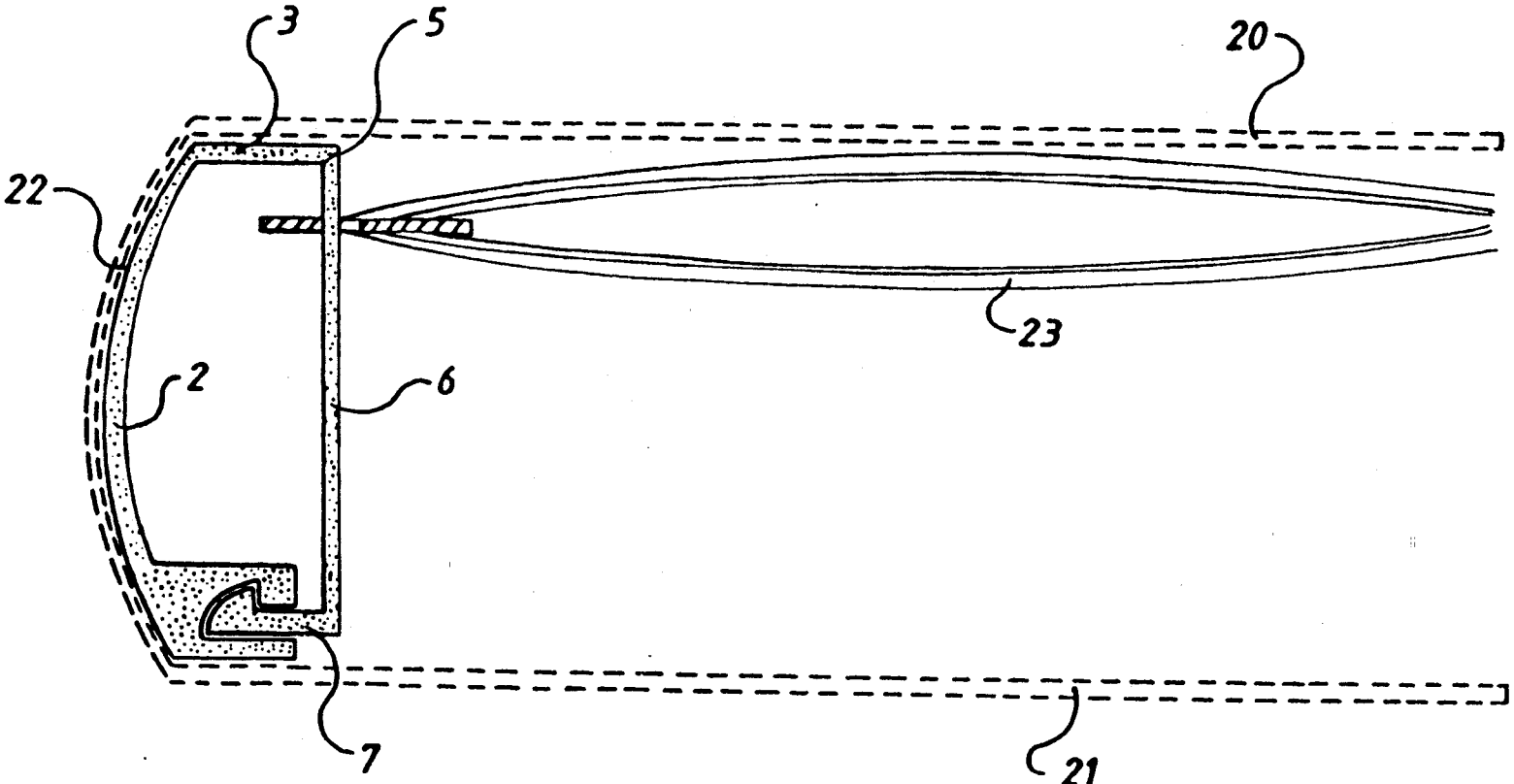
FIG. 2 is an end view of the spine of FIG. 1 in the closed position.

Referring now to FIGS. 1 and 2, the binder spine illustrated comprises a channel-like body portion 1 having a base 2 and side walls 3 and 4 extending along its length.

Side wall 3 is formed at its longitudinal edge remote from the base 2 with a hinge connection 5 joining side wall 3 to a lid 6. The lid 6 is planar and substantially corresponds in length and width to the base 2.

At the edge of lid 6 remote from hinge connection 5, a detent 7 is formed to extend longitudinally of the lid, and perpendicularly thereto. The detent 7 extends toward the body portion 1, and has an abutment surface 8 facing towards the lid 6, on its side nearest the hinge connection 5.

Side wall 4 of the body portion 1 is itself formed as a channel section, and has within the channel an undercut locking face 9 facing towards the base of the channel on its side nearest the hinge connection 5.

The dimensions of the body 2 and lid 6 are such that relative rotation about the hinge connection brings the detent 7 into the channel formed in the side wall 4, and resilient deformation takes place to allow the detent surface 8 to snap-engage the undercut locking face 9 to retain the body 1 and lid 6 in a closed position.

At the ends of the lid 6, recesses 10 and 11 are formed across the greater part of the width of the lid 6. The depths d of these recesses are such that the end parts 12 and **12*a* of loops 13 encircling the lid 6 are accommodated within the recesses 10 and 11**.

To allow loops 13 to be placed round lid 6 and removed therefrom as desired, a slot 14 extends longitudinally from the recess 11 adjacent the detent 7 of the lid 6. The slot 14 has a longitudinal extent 1 at least equal to the depth d of the recesses 10 and 11. To remove a loop 13, its end part 12 situated within recess 11 is moved laterally until it is over the end of the slot 14, and the entire loop may then be moved longitudinally relative to the spine by a distance 1 to position the end part 12 within the slot 14. This allows the end part **12*a* of the loop 13 originally within recess 10 to move out of the recess, and the loop end 12*a* may then be moved laterally to disengage it from the lid 6. By a second longitudinal movement in the opposite sense to the first, end part 12 of the loop 13 may be drawn out of the slot 14 and out of the recess 11 to completely disengage the loop 13 from the lid 6**.

To apply a loop 13 over the lid 6, the reverse procedure is adopted, first placing one end 12 of the loop 13 in slot 14 and then placing the other end **12*a* into the recess 10 while drawing the first end 12 out of slot 14 and into recess 11**.

Figure 3:
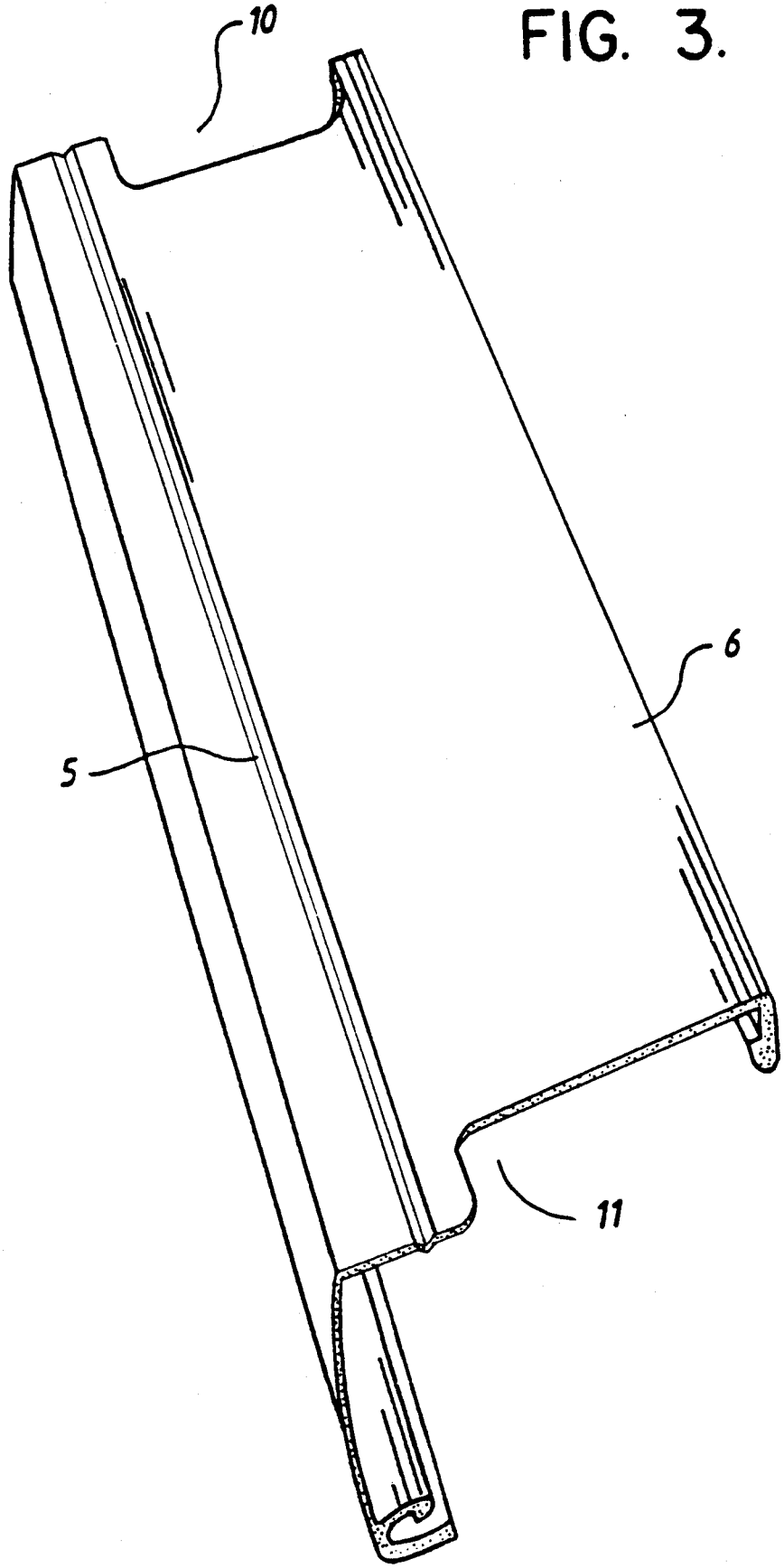
FIG. 3 is a view similar to FIG. 1 of a further variant of the spine.

If, as is shown in FIG. 3, one of the recesses 10 and 11 is arranged to extend completely across the lid 6, slot 14 may be omitted and loops 13 may be simply placed over the lid 6 by inserting one end part 12*a* into the recess 10 and then passing the other end part 12 laterally into recess 11.

Returning now to FIG. 2, the spine is shown in a binder, the end boards of the binder being shown in phantom at 20 and 21. A curved spine board 22 is also shown in phantom. For binders where the end and spine boards are of flat PVC covered card, the body 2 may be welded to the spine board 22 or may be riveted or bonded thereto with an adhesive. Where the binder boards 20, 21 22 are simply card covered in paper or other sheet material, then a hot melt or other adhesive or a double-sided adhesive tape may be used to fix the spine into the binder. Alternatively, the spine may be fixed by rivets or the like passing through the base 2 and the spine board 22 of the binder.

As a further alternative, the spine may be provided with an adhesive layer or strip extending along the outside of the body 1, and covered by a release liner. A user may then select an appropriate spine from a range of sizes, and fix it into a cover selected from a range of sizes and finishes. This has the further advantage that spines and covers may be transported separately to the point of sale, reducing the bulk of the packaging otherwise necessary for transporting assembled binders. In a further advantageous embodiment, the body portion of the spine may have its base and sidewalls joined together by integral hinges, so that the entire spine may be opened out to a substantially flat configuration. This will allow efficient storage and transportation of the unassembled binder spines, the spines being kept in their flat configuration either separately from the cover, or in a flat array wherein the front and rear boards and spine board of the cover are in a flat array with the base of the spine fixed to the spine board of the cover.

Preferably the spine is assembled so as to have the hinge connection 5 positioned at what will be the front of the bound volume of magazines. This allows sequential addition of loops 13 and magazines 23 as a series of magazines is published, the latest magazine being added without the necessity of disturbing previous issues.

Figure 4:
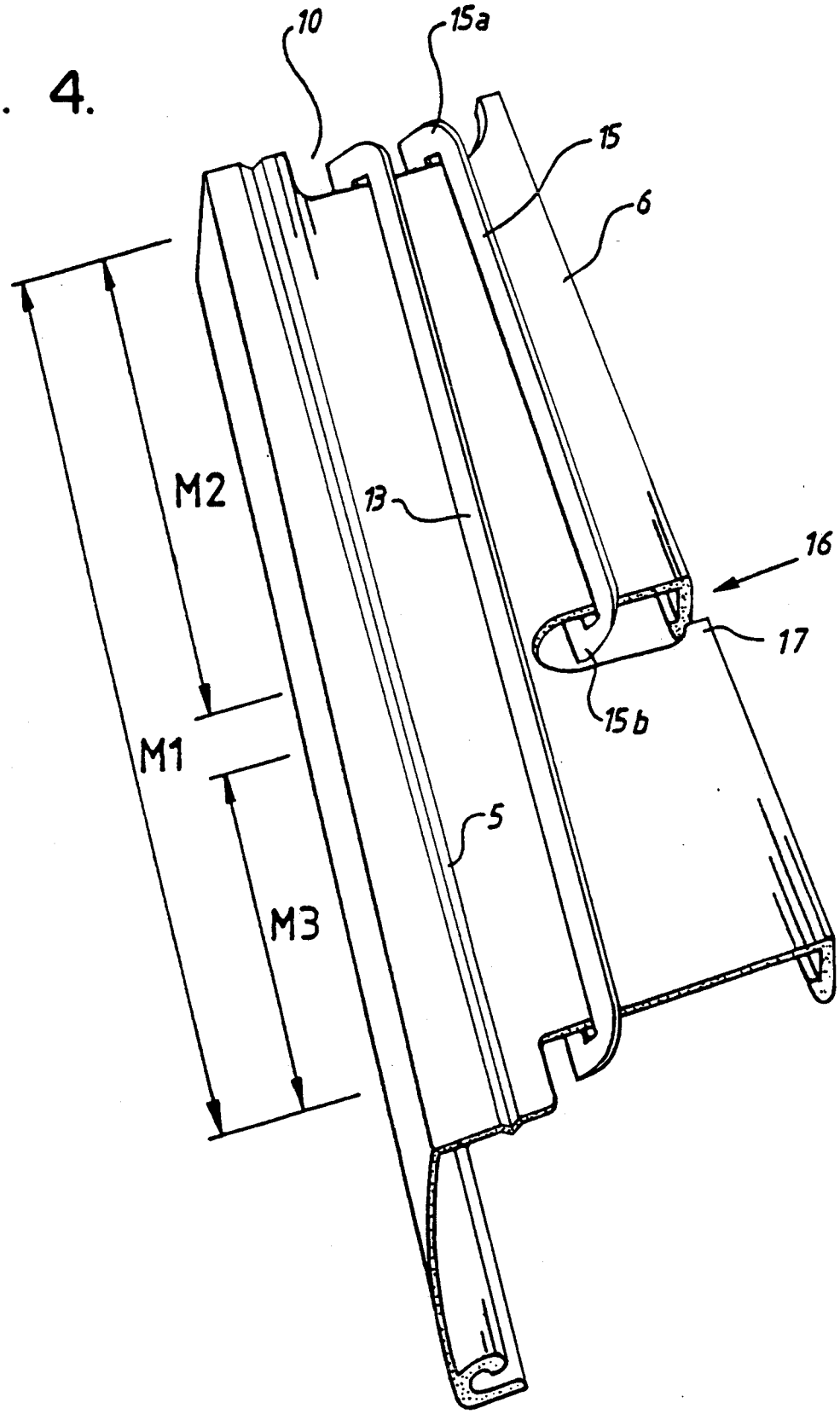
FIG. 4 shows a view similar to FIG. 3 of a spine modified to accept loops of more than one size.
Figure 5:
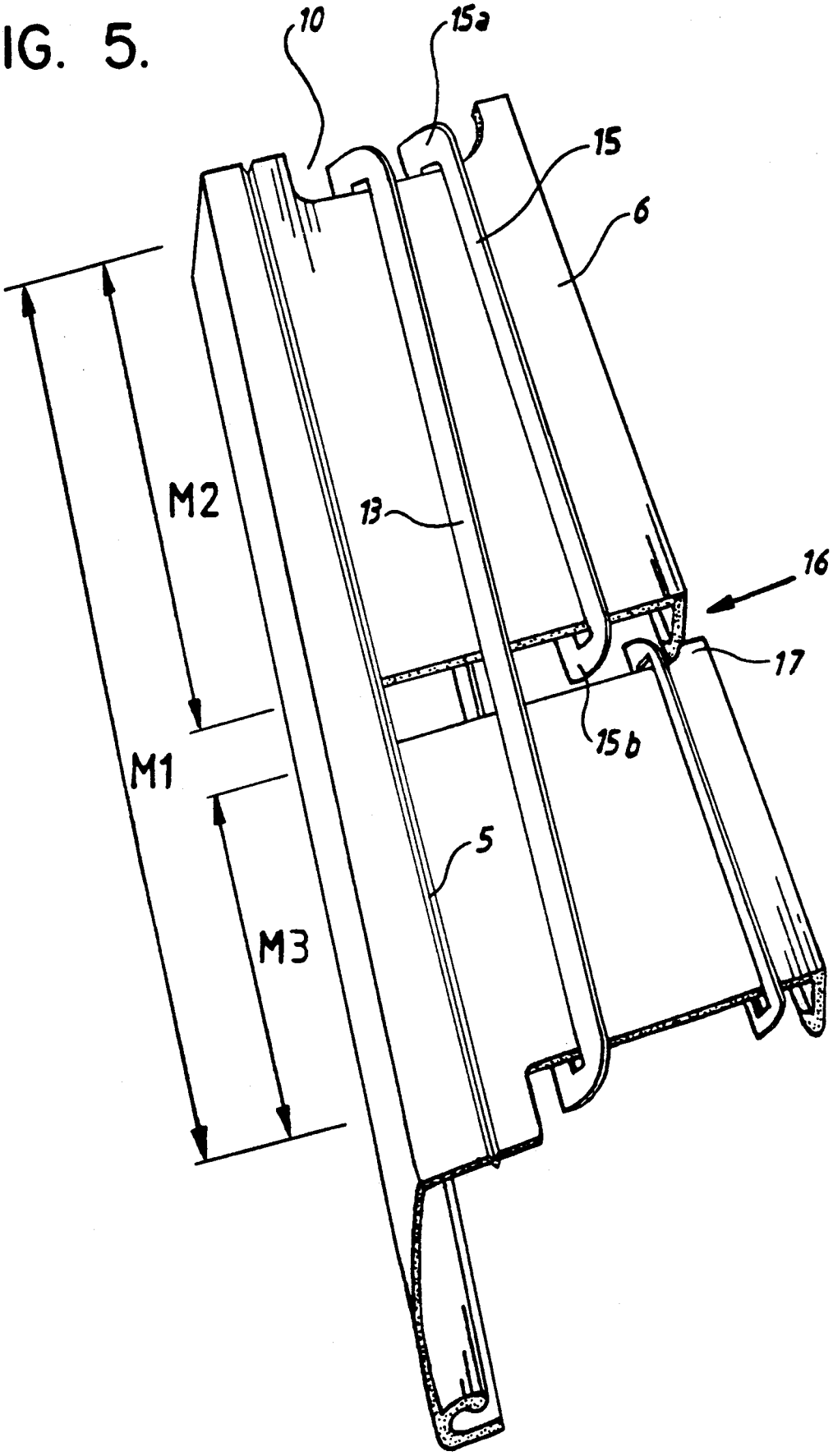
FIG. 5 shows a view similar to FIG. 1 of a further variant of the spine assembly.
Figure 6:
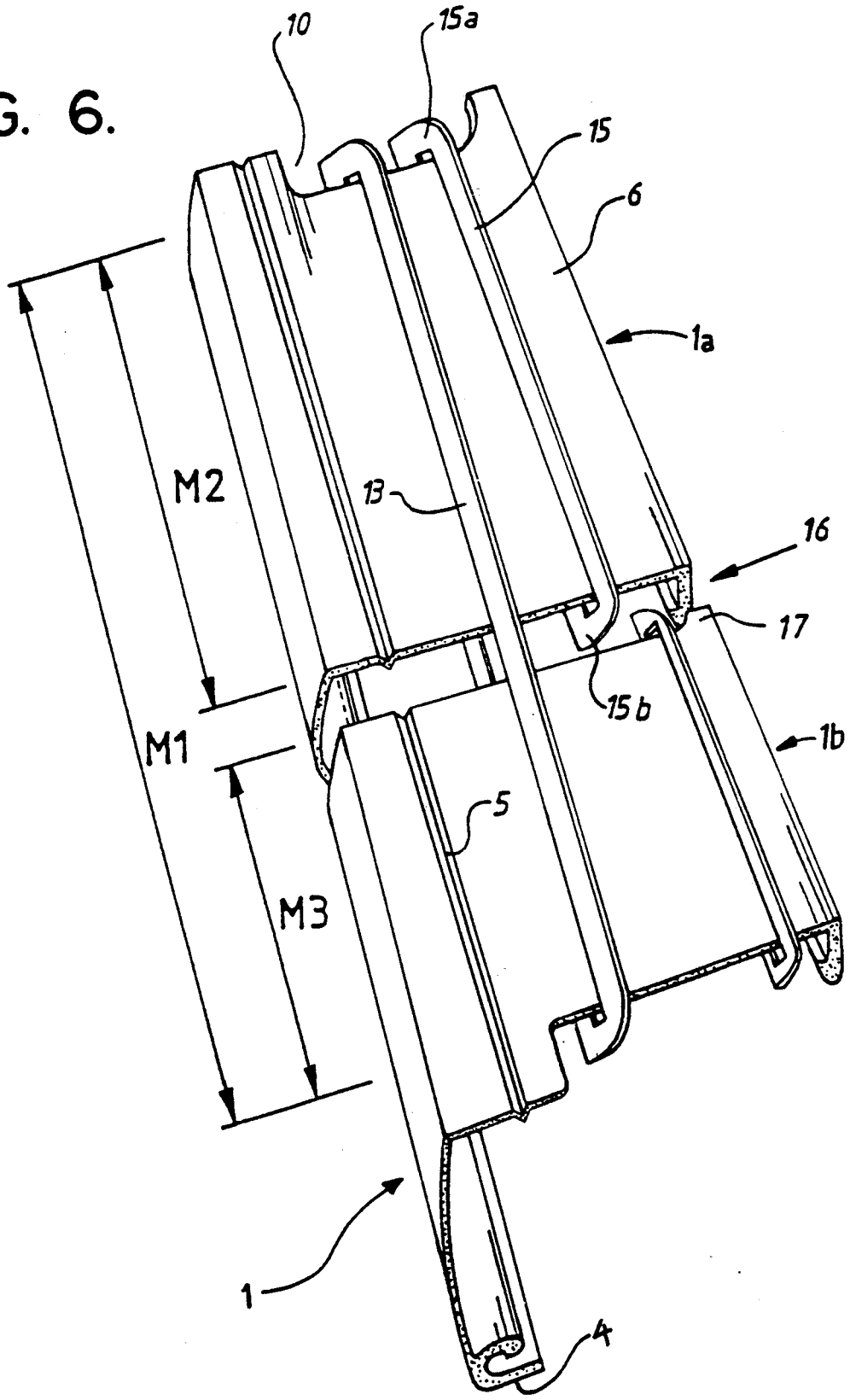
FIG. 6 shows a view similar to FIG. 1 of a further variant of the spine assembly.

FIG. 4 shows a further alternative embodiment of the spine, adapted to accept loops 13 of a length substantially equal to that of the spine and also capable of accepting loops 15 of a shorter length.

The lid 6 of the spine of FIG. 4 is formed with a laterally extending slot 16 intermediate its length, the slot 16 extending partially across the lid 6 from its edge opposite the hinge 5. The slot 16 may, in an alternative embodiment, extend completely across the lid to the hinge 5, to divide the lid 6 into two separate portions.

As will be appreciated from FIG. 4, the loops 13 are used to hold magazines whose spine length is M1, and loops 15 are used to hold magazines of spine length M2. The loops 15 are placed on the spine lid 6 by first inserting loop end 15*a* into the recess 10 at the upper end of lid 6 as shown in the Figure; lower end 15*b* of the loop 15 may then be introduced into slot 16. The lid 6 is then closed, to retain the loops in place.

By making the slot 16 sufficiently wide, and providing a retaining projection 17 at its open end, a further series of loops (not shown) may be placed so as to extend between the slot 16 and the lower end of the spine as shown in the Figure. Thus, magazines having a spine length M3 may also be accommodated in the binder, with magazines of spine lengths M1 and M2.

It is also foreseen to provide more than one slot 16, to further increase the number of different sizes of magazine capable of being received in a single binder.

Clearly alternative arrangements of the resilient latching between the lid 6 and body 1 of the spine are possible. It is also possible to provide grip means or lever arrangements integral with or mounted on the body 1 and/or lid 6 to facilitate de-latching to open the spine for addition or removal of loops 13, or to provide a recess (shown at 18 in FIG. 1) to enable a finger or a tool such as a pencil to be hooked under the lid 6 to open it.

In a further alternative, a tool (not shown) may be provided to ease opening of the spine, the tool being either inserted in an open end of the spine or via a recess such as 18. The tool may operate either as a lever, or with a wedge or cam action to urge the lid 6 away from the base 2, or the tool may operate to release the latching engagement between the surfaces 8 and 9.

As has been mentioned above, the possibility exists of extending the transverse slot 16 across the entire width of the lid 6 to form two separate lid parts. Likewise, it is foreseen that the binder spine may be provided in two separate coaxially aligned spine parts 1*a* and 1*b*, each part 1*a* and 1*b* having a body and a lid, the loops 13 extending round the lids of both spine parts. Clearly, a plurality of such spine parts may be placed in a coaxial array along the spine board of a binder, so that loops 13 of various sizes may extend either between adjacent pairs of spine parts, or may enclose three or more spine parts.

Since in the spine arrangements of the present invention loops 13 may be added or removed from the binder spine as required, it is further foreseen that the loops may be formed with integral filling pockets, indexing divisions, or other aids to the organisation of material bound in the binder.

I claim:

1. A spine assembly for a binder comprising:

a body portion comprising an elongate base and at least one sidewall which is rigidly attached to said base and which extends along the longitudinal side of the base;

a lid portion which is hingedly attached to the base and releasably fixed to the sidewall, the body and lid portions forming a tubular spine structure when fixed together; and a plurality of elongate loops, each loop having substantially parallel longer sides and two shorter ends, each loop being positionable about the lid portion such that one of the longer sides extends longitudinally within the tubular spine structure when the lid is fixed to the body and the other longer side extends longitudinally outside the spine and adjacent the outer surface of the lid portion.

2. The spine assembly of claim 1 wherein the lid and body portions are separate components.

3. The spine assembly of claim 1 wherein the lid and body portions are permanently joined by a hinge extending along adjacent longitudinal sides of the lid and body portions.

4. A spine assembly according to claim 3, wherein the hinge portion is of a material different from the material of the body and lid portions.

5. A spine assembly according to claim 3 wherein the lid portion has at least one transverse slot which extends from a longitudinal edge of the lid portion to the hinge, such that the lid portion is divided into two separate parts.

6. A spine assembly according to claim 5, wherein a first series of loops is positionable so as to encircle one of the lid parts, a second series of loops is positionable to encircle the other lid part, and a third series of loops is positionable to encircle both lid parts simultaneously.

7. A spine assembly according to claim 6, wherein the first and second series of loops are of different sizes, and the transversely extending slot divides the lid portion of the spine into two lid parts of unequal longitudinal extent.

8. A spine assembly according to claim 5, wherein two or more transverse slots divide the lid portion into three or more separate lid parts, the lid parts being of the same or of differing longitudinal extent.

9. The spine assembly of claim 1 wherein the lid and body portions are extruded from plastics material and are integrally joined by a deformable hinge portion.

10. The spine assembly of claim 9 wherein the body, lid and hinge portions are formed by co-extrusion.

11. The spine assembly of claim 1 wherein the lid portion and body portions are formed from polyvinyl chloride.

12. The spine assembly of claim 1 wherein the lid portion is formed with one or more open-ended slots extending transversely from a longitudinal edge of the lid portion, the arrangement of the slot being such that one or more secondary loops may be positionable about the lid portion so as to extend through a slot.

13. A binder including a front cover board, a rear cover board, and a spine board, the spine board having attached thereto a spine assembly according to claim 1.

14. A binder according to claim 13, wherein two spaced and coaxially aligned spine assemblies are provided, each spine assembly having a body portion fixed to the binder spine board and a lid portion, the arrangement being such that a series of loops of a first size is positionable so as to encircle one of the lid portions, a series of loops of a second size is positionable to encircle the other lid portion, and a series of loops of a third size is positionable so as to encircle both lid portions.

15. A binder according to claim 14, wherein the two spine assemblies are of differing longitudinal extent.

16. The spine assembly of claim 1 further comprising the body portion having an additional sidewall along the other longitudinal side of the base and wherein the lid portion is hingedly attached to one of the sidewalls and is releasably fixed to the other sidewall.

17. The spine assembly of claim 16 wherein the other sidewall of the body portion is hingedly attached to the base and to the lid portion, so that the base, the sidewall, and the lid portion may be folded to form a planar array.

18. A spine assembly for a binder comprising:

a body;

two lid parts, each lid part being separate from the other and being releasably fixed to the body, each lid and the adjacent portion of the body forming coaxial tubular structures when fixed together;

a plurality of continuous elongate loops, each loop having first and second longer sides and first and second shorter ends, the longer sides of each loop being dimensioned such that the loop is positionable about the lid parts such that the first longer side extends axially through one or both of the tubular structures and the second longer side extends along the outer surfaces of one or both lid parts.

* * * * *